US008141809B2

(12) United States Patent
Meyer

(10) Patent No.: US 8,141,809 B2
(45) Date of Patent: Mar. 27, 2012

(54) CROSS-CUTTING AND ROLL-CHANGEOVER APPARATUS FOR CONTINUOUS MOVING WEB

(75) Inventor: Helmut Meyer, Troisdorf (DE)

(73) Assignee: Reifenhauser GmbH & Co., KG Maschinenfabrik, Troisdorf (DE)

( * ) Notice: Subject to any disclaimer, the term of this patent is extended or adjusted under 35 U.S.C. 154(b) by 9 days.

(21) Appl. No.: 12/234,793

(22) Filed: Sep. 22, 2008

(65) Prior Publication Data

US 2009/0242684 A1 Oct. 1, 2009

(30) Foreign Application Priority Data

Sep. 22, 2007 (EP) ..... 07018666

(51) Int. Cl.
*B65H 35/04* (2006.01)
*B65H 19/28* (2006.01)

(52) U.S. Cl. ..... 242/527.3; 242/532.2

(58) Field of Classification Search ..... 242/522, 242/523, 523.1, 526, 527, 527.2, 527.3, 532, 242/532.2, 532.3, 533, 533.2, 533.3, 533.4, 242/533.5, 533.6, 548, 548.4
See application file for complete search history.

(56) References Cited

U.S. PATENT DOCUMENTS

| | | | | |
|---|---|---|---|---|
| 4,196,865 | A * | 4/1980 | Patriksson | 242/521 |
| 4,678,133 | A * | 7/1987 | Suzuki | 242/527.3 |
| 4,770,358 | A * | 9/1988 | Suzuki et al. | 242/527.3 |
| 5,318,237 | A * | 6/1994 | Lotto et al. | 242/532.2 |
| 5,383,622 | A | 1/1995 | Kohler | 242/527.2 |
| 6,474,589 | B1 | 11/2002 | Enwald | 242/527.2 |
| 6,752,348 | B2 * | 6/2004 | Dreckmann et al. | 242/542.3 |
| 7,036,763 | B2 * | 5/2006 | Bohm et al. | 242/542.3 |
| 7,093,785 | B2 * | 8/2006 | Meyer et al. | 242/542.3 |
| 7,128,289 | B2 * | 10/2006 | Perini | 242/532.2 |
| 2002/0179769 | A1 | 12/2002 | Dreckmann | 242/527.3 |

FOREIGN PATENT DOCUMENTS

| | | |
|---|---|---|
| DE | 19542096 | 10/1996 |
| GB | 1133948 | 11/1968 |

* cited by examiner

*Primary Examiner* — William E Dondero
(74) *Attorney, Agent, or Firm* — Andrew Wilford

(57) ABSTRACT

An apparatus for winding a flexible web continuously moving in a longitudinal travel direction as rolls onto sleeves has a winding station for holding a sleeve and rotating it about an axis for winding the web onto the sleeve. Upstream of the winding station at a changeover station a fresh sleeve is held adjacent the continuously moving web. A shell juxtaposed with the fresh sleeve in the changeover station forms therewith a gap. A cross-cutter for the web is provided adjacent an end of the gap and can form on the web a trailing end and a leading end so that the trailing end travels to the winding station for winding on the sleeve therein. Air is drawn air into the end of the gap to aspirate the leading end into the gap. This leading end is electrostatically adhered to the fresh sleeve in the changeover station.

10 Claims, 2 Drawing Sheets

CROSS-CUTTING AND ROLL-CHANGEOVER APPARATUS FOR CONTINUOUS MOVING WEB

FIELD OF THE INVENTION

The present invention relates to a system for winding up a web. More particularly this invention concerns an apparatus for winding the web up into roll and periodically cutting the web while changing the roll.

BACKGROUND OF THE INVENTION

After a web is manufactured it is normally wound up onto rolls each holding a considerable length of the freshly made web, for instance a plastic sheet. Since the manufacturing process is a continuous one, the rolls must be produced without interrupting the movement of the web, that is in a quick operation the web must be cross cut, the full roll must be moved out of the way, and the fresh leading end created by the cross cut must be applied to and wound on a fresh sleeve.

An apparatus of the type described above has been disclosed in DE 195 42 906. Here the sleeve onto which the web is to be wound is partially surrounded by a guide shell during the roll-changeover operation. At the beginning of a roll-changeover operation, a continuously fed plastic foil is cross-cut by means of a separate cutter. In the region of this cross-cutting action, air is blown at high speed into the flow gap through a slot nozzle. The result is that a partial vacuum is created below the plastic foil and the end of the web is sucked into the flow gap and pressed against the sleeve onto which material is to be wound. While this known device has fundamentally proven to be successful, it nevertheless is characterized by certain disadvantages. The known device has a relatively high number of parts and is consequently of relatively complex design, thereby necessitating correspondingly expensive servicing and maintenance measures. In addition, the cross-cutting and roll-changeover operation in this known device takes a relatively long time. Another disadvantage consists in the fact that it is not possible to do a fold-free winding of the end of the web onto the sleeve.

Another aspect known from use in practice is to specially prepare the sleeves for the roll changeover, in particular, to provide them with an adhesive. However, an apparatus that is breakdown-prone and of costly design is required for this purpose.

OBJECTS OF THE INVENTION

It is therefore an object of the present invention to provide an improved cross-cutting and roll-changeover apparatus for a continuously moving web.

Another object is the provision of such an improved cross-cutting and roll-changeover apparatus that overcomes the above-given disadvantages, in particular that is of relatively simple and less costly design, that executes an efficient cross-cutting and roll-changeover operation, and that also provides fold-free roll changeover to the fresh sleeve.

SUMMARY OF THE INVENTION

An apparatus for winding a flexible web continuously moving in a longitudinal travel direction as rolls onto sleeves has according to the invention a winding station for holding a sleeve and rotating it about an axis for winding the web onto the sleeve. Upstream of the winding station in the direction at a changeover station a fresh sleeve is held adjacent the continuously moving web. A shell juxtaposed with the fresh sleeve in the changeover station forms therewith a gap. A cross-cutter for the web is provided adjacent an end of the gap and can form on the web a trailing end and a leading end so that the trailing end travels to the winding station for winding on the sleeve therein. Air is drawn air into the end of the gap to aspirate the leading end into the gap. This leading end is electrostatically adhered to the fresh sleeve in the changeover station.

According to the invention during the final winding of a roll the continuously fed material web or plastic foil is cross-cut by means of a cutter. The fully wound roll is then easily removed with the wound-up trailing end of the web. The leading web end of the cross-cut material web is at about the same time transferred by winding onto a fresh sleeve onto which material is to be wound. It is thus within the scope of the invention that during the roll-changeover operation the fresh sleeve in the changeover station is rotated. In order to effect roll changeover of the web end onto the fresh sleeve, an air stream of high flow energy is introduced or blown into the flow gap, thereby generating a partial vacuum at the inlet of the flow gap that draws the web leading end into the flow gap. The additional electrostatic charge according to the invention enables the drawn-in web leading end to adhere to the sleeve in an optimal manner.

The invention is thus based on the recognition, first of all, that it is of great advantage if the cutter for cross-cutting the material web is attached to the guide shell or is an integral part of the guide shell. In combination with this design according to the invention, however, the electrostatic charge also is of very special significance. The result is that this combination ensures an extremely efficient and at the same time functionally reliable roll changeover onto the fresh sleeve. The operation can be effected at an overall higher winding speed as compared with the known apparatus described in the introduction, and, most importantly, a fold-free roll changeover can be implemented in a functionally reliable manner.

It is recommended that during the roll-changeover operation the guide shell angularly surrounds the sleeve inserted into the roll-changeover device over an angle of at least 45°, preferably at least 60°, and especially preferably at least 100°. It is then within the scope of the invention that the flow gap formed between the guide shell and the sleeve also extends over this angle.

At the start of the roll-changeover operation, the guide shell along with the attached cutter is advantageously pivoted onto the sleeve onto which material is to be newly wound, with the result that the material web or plastic foil is cross-cut by the cutter. Preferably, the material web passes over the sleeve, and the guide shell with its attached cutter is pivoted in or onto the sleeve such that the material web is cross-cut by the cutter downstream of the sleeve in the travel direction. Cross-cutting is effected while the sleeve rotates. The pivoting-on of the guide shell onto the sleeve also means that a radial spacing between sleeve and guide shell corresponding to the flow gap is always there.

According to the invention the cutter is permanently attached to the guide shell. The cutter is thus movable or pivotal together with the guide shell. An especially preferred embodiment of the invention is characterized in that the cutter attached to the guide shell is a chopper. In an especially preferred embodiment of the invention, the cutter involves a serrated knife or a chopper in the form of a serrated blade. The implementation in the form of a chopper or a serrated knife has proven especially successful within the scope of the invention. A roll changeover that is of special functional reliability and precision is provided by the fact that cross-cut is done by a chopper or serrated knife permanently attached to the guide shell, and that additionally the electrostatic charge is implemented in combination with the above.

In accordance with the invention air is blown in or introduced into the flow gap near the cutter. What is involved here is advantageously air of a high flow energy or high flow rate.

Where reference is made within the scope of the invention to blow-in device, what is meant first of all is an apparatus by which the air is blown into the inlet of the flow gap. Secondly, what is meant thereby as well in another embodiment, however, is a suction device that draws in or sucks in air into the flow gap, thereby generating the above-described partial vacuum at the inlet of the flow gap. It is within the scope of the invention that the blow-in device is an integral part of the guide shell, or is attached to the guide shell. In an especially preferred embodiment of the invention, the blow-in device relates to a transvector. Within the scope of the invention, a "transvector" is a slot nozzle that advantageously extends transversely across at least the largest part of the width of the material web, and preferably extends across ver the entire width, or virtually the entire width of the material web. An air curtain having a high flow energy or high flow rate is created by this slot nozzle and blown into the flow gap, thereby creating the partial vacuum at the inlet of the flow gap. As a result, the web end of the cross-cut-running material web is drawn into the flow gap (injector principle) and the web end is deposited onto the fresh sleeve.

As was already explained above, within the scope of the invention the electrostatic charge is of special significance in combination with the other features according to the invention. The electrostatic charging device advantageously relates to at least one charging electrode. An especially preferred embodiment of the invention is characterized in that the sleeve onto which material is to be newly wound is charged by the electrostatic charging device. This enables an especially functionally reliable roll changeover of the web end onto the sleeve to be achieved. Fundamentally, it is also within the scope of the invention that the material web or sheet is electrostatically charged. In addition, the web end is advantageously transferred by winding onto the (otherwise) unprepared (in particular, adhesive-free) sleeve.

In a highly-recommended embodiment of the invention, the face of the guide shell turned inward toward the winding sleeve is of a porous or microporous design. This design of the guide shell enables any undesired adhesion of the web end or sheet on the guide shell to be prevented. This feature is also of special significance in combination with the features of the invention already revealed above.

According to the apparatus of the instant invention a very efficient cross-cutting and roll-changeover operation can be done. The web end can be transferred by winding onto the fresh sleeve onto which material is to be wound in a very functionally reliable manner using the apparatus according to the invention. One aspect to be highlighted in particular here is that roll changeover can be implemented fold-free, in contrast to measures known from prior art. The apparatus according to the invention is furthermore characterized by a simple and low-cost design. Advantageously, fewer costly servicing and maintenance measures are required in comparison with devices known from the prior art as a result. One particular advantage consists in the fact that winding equipment that already exists or is operational can be equipped with the components according to the invention. The result is that a surprisingly simple, efficient, and precise roll changeover is possible with the apparatus according to the invention.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
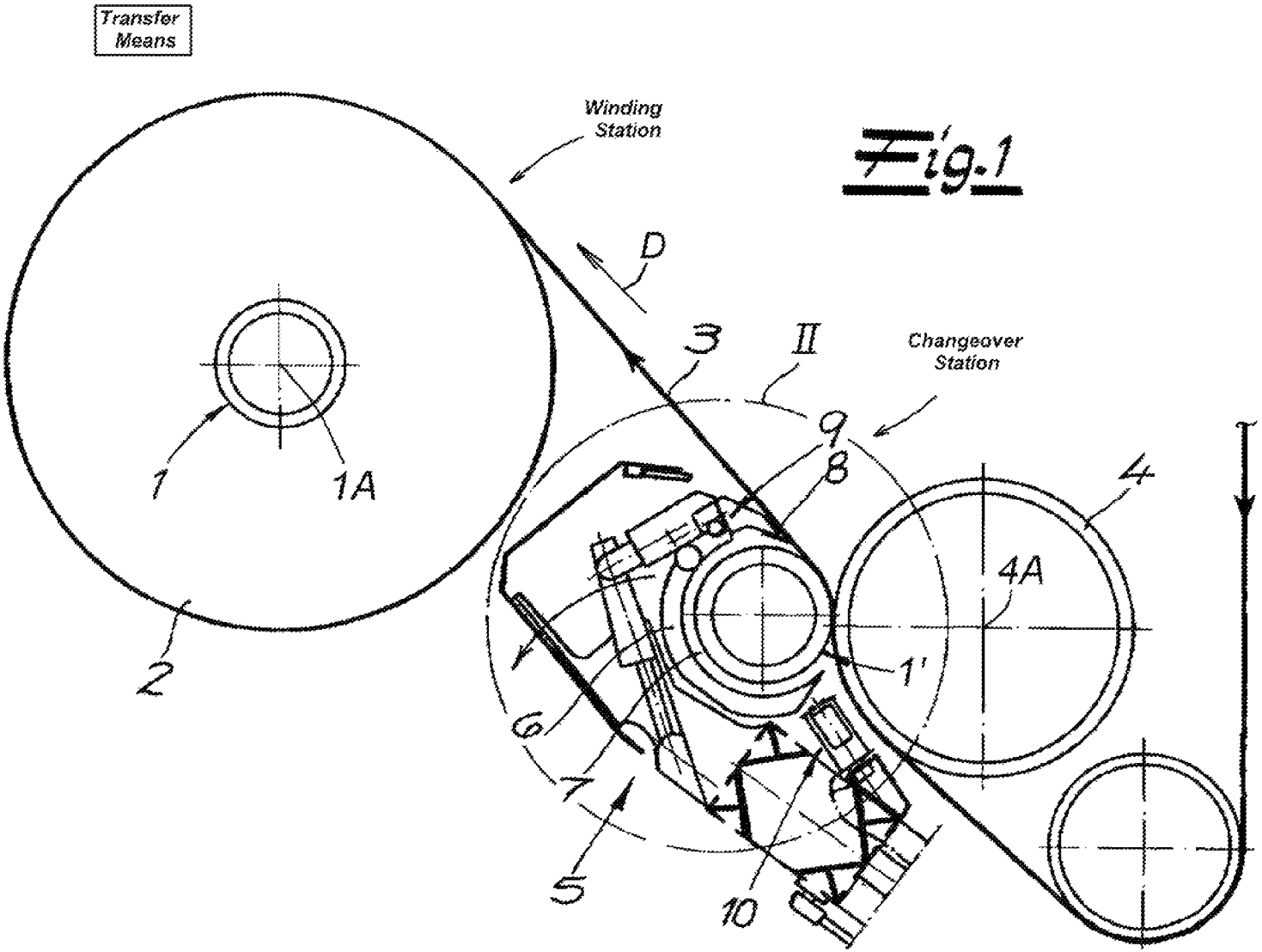
FIG. 1 is a partly schematic side view of the apparatus according to the invention.
Figure 2:
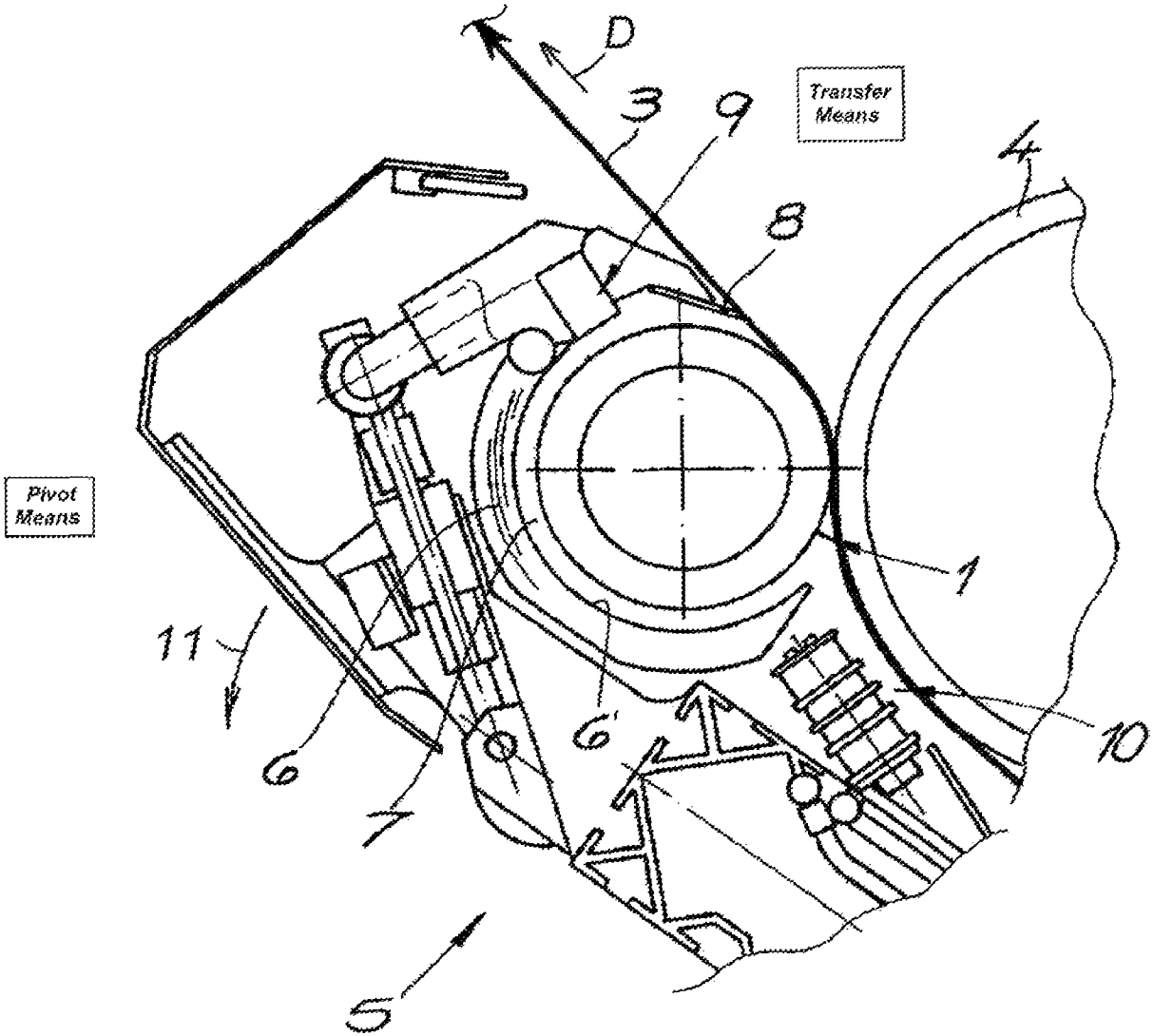
FIG. 2 is the enlarged detail shown at II of the structure of FIG. 1.

As seen in FIGS. 1 and 2 an apparatus according to the invention serves for cross-cutting and roll changeover of a fed material web being wound up onto a sleeve 1 rotatable about an axis 1A to form a roll 2. The material web according to the invention is a plastic sheet or foil 3. In the embodiment, the sheet 3 passes around a contact roller 4 rotatable about an axis 4A parallel to the axis 1A and then runs over a fresh sleeve 1' onto which material is to be wound and that is held in a roll-changeover device 5 for the purpose of the roll changeover. This roll-changeover device 5 has a part-cylindrical guide shell 6 that partially surrounds the sleeve 1' in the roll changeover position shown in the figures. An arcuate flow gap 7 is formed between the sleeve 1 and the guide shell 6 in the roll changeover position.

According to the invention, a cutter for cross-cutting the sheet 3 is attached to the guide shell 6. The cutter is a chopper in the form of a serrated knife 8 constituting means for cross-cutting the sheet 3. During transition into the roll changeover position, the guide shell 6 along with the attached serrated knife 8 are moved by pivot means about an axis parallel to the axes 1A and 4A onto the sleeve 1', and as a result, the sheet 3 passing over the sleeve 1' is cross-cut just downstream in a travel direction D of the sheet 3. The pivoting of the guide shell 6 is indicated by an arrow 11 in FIG. 2 that also schematically shows the means for pivoting the shell 6, sleeve 1', and knife 8.

The roll-changeover device 5 furthermore has a means for drawing air or a blow-in device 9 provided on the guide shell 6 and that directs a flat stream of air of high flow energy or at a high flow rate into the flow gap 7 adjacent the cutter 8. The leading web end formed after cross-cutting is sucked thereby into the flow gap (injector principle), thereby effectively ensuring transfer of the sheet 3 from the sleeve 1 to the sleeve 1'. A face 6' of the guide shell 6 turned inward toward the winding sleeve 1' is porous or microporous to prevent adherence of the sheet 3 to the shell 6.

The roll-changeover device 5 of the apparatus according to the invention furthermore has, according to the invention, an electrostatic charging device 10 or means for electrostatically adhering. In a preferred embodiment of the invention, the sleeve 1' onto which material is to be newly wound is electrostatically charged by this electrostatic charging device 10. This enables optimal adhesion on the sleeve 1' of the leading web end for the roll changeover to be achieved. Most importantly, the combination of the cutter 8 attached to the guide shell 6 on the one hand and the electrostatic charging device 10 on the other hand surprisingly ensure a functionally reliable fold-free roll changeover of the web end onto the sleeve 1'.

On the left side in FIG. 1, an essentially completely wound roll 2 is visible in a winding position. Following cross-cutting with the chopper 8, the finished roll 2 is removed along with the wound-up trailing end of the web by transfer means. After the roll changeover of the leading web end onto fresh sleeve 1, the sleeve 1' is swung by this transfer means along an arcuate path into the winding position centered on the axis 1A so that winding can continue. During this operation an unillustrated drive rotates the sleeve 1' so that the continuously arriving web 3 is would up. Meanwhile the full roll 2 is removed.

I claim:

1. In combination with a flexible plastic web continuously moving in a longitudinal travel direction, an apparatus for winding the web as rolls onto sleeves, the apparatus comprising:

a winding station holding a sleeve and rotating it about an axis for winding the web onto the sleeve;

a changeover station upstream of the winding station in the direction holding a fresh sleeve adjacent the continuously moving web;

a shell juxtaposed with the fresh sleeve in the changeover station and forming therewith a gap arcuately surrounding the fresh sleeve through an arc of at least 60°;

a blade on the shell;

means for pivoting the blade, shell, and fresh sleeve against the web and thereby pressing the web against the blade and thereby cross-cutting the web adjacent an end of the gap and forming on the web a trailing end and a leading end, whereby the trailing end travels to the winding station for winding on the sleeve therein;

a slot nozzle at and directed into the end of the gap and extending transversely across at least the largest part of a width of the material web;

means connected to the nozzle for expelling air therefrom and for thereby drawing air into the end of the gap and aspirating the leading end into the gap; and means at an opposite end of the gap from the slot nozzle for electrostatically charging the leading end or the fresh sleeve and thereby electrostatically adhering the leading end to the fresh sleeve in the changeover station.

2. The combination defined in claim 1, further comprising transfer means for removing the sleeve with the web and trailing end wound thereon from the winding station and shifting the fresh sleeve from the changeover station to the winding station.

3. The combination defined in claim 2, wherein the transfer means pivots the fresh sleeve through an arc from the changeover station to the winding station.

4. The combination defined in claim 1, wherein the arc is at least 100°.

5. The combination defined in claim 1, wherein the blade is a serrated knife.

6. The combination defined in claim 1, wherein the shell has a porous surface turned toward the fresh sleeve in the changeover station.

7. The combination defined in claim 1, wherein when the blade is engaged with the web, the shell still forms the gap with the fresh sleeve.

8. The combination defined in claim 1, wherein the slot nozzle is mounted on the shell.

9. The combination defined in claim 1, wherein the means for charging includes an electrode.

10. The combination defined in claim 1, wherein the sleeve is adhesive-free.

* * * * *